US005681065A

United States Patent [19]

Rua, Jr. et al.

[11] Patent Number: 5,681,065

[45] Date of Patent: Oct. 28, 1997

[54] RECYCLABLE INSTANT SCRATCH-OFF LOTTERY TICKET WITH IMPROVED SECURITY TO PREVENT UNAUTHORIZED DETECTION OF LOTTERY INDICIA

[75] Inventors: Louis Rua, Jr., Plainsboro; Christopher Tararuj, Trenton; Stephen Martin, Jamesburg, all of N.J.

[73] Assignee: Webcraft Technologies, Inc., Horsham, Pa.

[21] Appl. No.: 354,893

[22] Filed: Dec. 9, 1994

[51] Int. Cl.[6] ..... B42D 15/00

[52] U.S. Cl. ..... 283/903; 283/72; 283/95

[58] Field of Search ..... 283/72, 95, 903; 106/20 R, 21 R, 21 A; 162/134, 140; 273/269

[56] References Cited

U.S. PATENT DOCUMENTS

| | | | |
|---|---|---|---|
| Re. 34,673 | 7/1994 | Desbiens . | |
| 2,618,866 | 11/1952 | Adams . | |
| 3,602,513 | 8/1971 | Breen . | |
| 3,603,592 | 9/1971 | Bury . | |
| 3,618,231 | 11/1971 | Wason . | |
| 4,037,007 | 7/1977 | Wood . | |
| 4,084,332 | 4/1978 | Waloszyk et al. . | |
| 4,095,824 | 6/1978 | Bachman | 283/903 |
| 4,120,445 | 10/1978 | Carrick et al. | 283/903 X |
| 4,212,468 | 7/1980 | Knott | 273/240 |
| 4,273,362 | 6/1981 | Carrier et al. . | |
| 4,354,845 | 10/1982 | Poteet et al. | 434/410 |
| 4,425,386 | 1/1984 | Chang . | |
| 4,486,033 | 12/1984 | Parrotta . | |
| 4,488,646 | 12/1984 | McCorkle . | |
| 4,634,149 | 1/1987 | Donovan . | |
| 4,677,553 | 6/1987 | Roberts et al. . | |
| 4,725,079 | 2/1988 | Koza et al. . | |
| 4,726,608 | 2/1988 | Walton . | |
| 4,777,108 | 10/1988 | Adair . | |
| 4,835,624 | 5/1989 | Black et al. . | |
| 4,850,618 | 7/1989 | Halladay, Jr. | 283/903 X |
| 4,877,253 | 10/1989 | Arens . | |
| 4,881,758 | 11/1989 | Ben-David . | |
| 5,029,901 | 7/1991 | Dotson et al. . | |
| 5,058,925 | 10/1991 | Dotson . | |
| 5,074,566 | 12/1991 | Desbiens . | |
| 5,083,815 | 1/1992 | Scrymgeoor et al. . | |
| 5,106,089 | 4/1992 | Wood . | |
| 5,112,058 | 5/1992 | Sandeen . | |
| 5,193,815 | 3/1993 | Pollard . | |
| 5,193,854 | 3/1993 | Borowski, Jr. et al. . | |
| 5,213,664 | 5/1993 | Hansell . | |
| 5,217,258 | 6/1993 | Sanderson . | |
| 5,228,692 | 7/1993 | Carrier et al. | 283/903 X |
| 5,286,061 | 2/1994 | Behm . | |
| 5,542,710 | 8/1996 | Silverschutz et al. | 283/903 X |
| 5,569,512 | 10/1996 | Brawer et al. | 283/903 X |

FOREIGN PATENT DOCUMENTS

| | | |
|---|---|---|
| 621061 | 10/1994 | European Pat. Off. . |
| 2249966 | 11/1990 | United Kingdom . |

*Primary Examiner*—Willmon Fridie, Jr.

*Attorney, Agent, or Firm*—Shlesinger, Arkwright & Garvey LLP

[57] ABSTRACT

A piece of printed material has preprinted, hidden data and includes a structure which prevents premature or unauthorized revealing of the hidden lottery or gaming data. For example, an instant scratch-off lottery ticket according to the invention includes a substrate, an ink layer disposed on the substrate, the ink layer including hidden lottery data. An ink-receptive layer is provided between the ink layer and the substrate and includes a first security mechanism for preventing unauthorized detection of the hidden data. A second security mechanism is disposed between the ink-receptive layer and the substrate which further prevents unauthorized detection of the lottery data.

30 Claims, 2 Drawing Sheets

RECYCLABLE INSTANT SCRATCH-OFF LOTTERY TICKET WITH IMPROVED SECURITY TO PREVENT UNAUTHORIZED DETECTION OF LOTTERY INDICIA

FIELD OF THE INVENTION

The invention relates to the physical structure of multi-layered printed matter. In particular, this invention relates to lottery tickets of the instant scratch-off type, and even more particularly to means for maintaining the security of the covered game data in instant scratch-off lottery tickets constructed to permit recycling into other paper products.

BACKGROUND OF THE INVENTION

Instant scratch-off lottery tickets are being increasingly sold by government and charitable entities around the world as sources of revenue.

Instant scratch-off lottery tickets contain hidden pre-printed winning and losing game data which distinguishes this form of lottery from the various other forms in which winning numbers are drawn some time after the sale of the ticket. The growth of popularity of instant scratch-off lottery with the public is explained by the public's ability to immediately learn if the ticket is a winner or loser. The increasing popularity with the governmental and charitable entities is explained by the advantage of knowing in advance the precise number of winners and the total value of the winnings when an entire lot of tickets will have been sold.

It is a well known type of gaming form that includes preprinted indicia covered by an opaque material. The opaque material is removed usually by scratching off the material, thus revealing the indicia. The indicia then determine whether or not the gaming form is a winner and the value of the winner. A common type of this gaming form is usually referred to as an instant or scratch-off lottery ticket. These games have a specific type of needed security. There must be certainty that the person distributing the tickets (e.g. the store clerk) cannot distinguish winning from losing tickets.

Historically, the games demanding the highest level of security, such as, state lottery instant ticket games, have been printed on foil laminated boardstock. Recently, with the ever-increasing environmental awareness, there has been a movement to print lottery tickets on boardstock without foil since this type of ticket is more amenable to be recycled. This change has caused an increasing concern with security since the foil barrier has been removed. The foil made the ticket secure because it prevented two types of intrusive surreptitious readout of the data. First, it acted as an optical barrier sufficient to prevent any attempt at candling the ticket. ("Candling" is defined as holding the ticket to some bright light source so that a sufficient amount of light passes through the ticket so that the game play indicia are readable.) The totally light proof foil prevents candling. Second, there are various methods of surreptitious readout which are normally attempted from the front of the ticket. The presence of the foil prevents the viability of these methods from the back side of the indicia.

One especially difficult security issue deals with the ink-jet imaging ink used for printing the computer randomized indicia on these tickets. Without the foil this liquid imaging ink will soak down into the paper fibers. If the ticket is then split, the game data is readable in reverse as the ink has now absorbed into the fibers in the area of the split. In order to prevent this problem several solutions have been proposed. First, the use of a black paper with a thin white coating has been used. In this product when the ink from the indicia reaches the paper fibers, they cannot be read since there is no contrast between the black ink and the black paper. The drawback to this solution is that black paper is unwanted by paper recyclers, and therefore, cannot be recycled in the general paper recycling stream of a community. A second solution is to use a black coating or ink on the paper and to cover this with a white coating or ink. This is to reduce the contrast between the black ink and the black coating. The difficulty with this method is that many methods of invasive ticket tampering are known where the ink of the indicia can be drawn through the black coating and into the white paper fibers. Once the ink is in the white fibers it can be read as before.

Prevention of non-damaging premature or unauthorized disclosure of winning and losing tickets is of great importance in instant scratch-off lottery tickets because the tickets are generally sold through retail dealers who may have access to groups of tickets over periods of several days prior to sale. In such time periods it could be possible, if not prevented by technological means, that a dealer could select losers for sale to the public and winners for his own disposition. Known destructive means of premature game data disclosure do not generally threaten the integrity of instant scratch-off lottery tickets because these techniques reveal tampering and render the tickets generally unsaleable.

Because of the growth in the use of instant scratch-off lottery tickets, concern has arisen as to impact of large quantities of the tickets on the environment, particularly when discarded to eventual landfill. This concern was heightened because the conventional physical structure of instant scratch-off lottery tickets includes a thin layer of aluminum foil which renders used tickets and waste that occurs during the manufacture of instant scratch-off lottery tickets non-recyclable to paper products. The aluminum foil along with certain printed and coated elements was heretofore essential in instant scratch-off lottery tickets to prevent premature disclosure of winning and losing tickets by one of several non-damaging techniques. The possibility of such premature disclosure must be prevented in order to maintain the integrity of the lottery and acceptability of the lottery ticket to the public.

The conventional structure of instant scratch-off lottery tickets is based on aluminum clad cardboard. The aluminum cladding is usually of the order of 0.0003 inches in thickness adhered to cardboard stock typically of 0.010 inches in thickness. The surface of the aluminum normally must be treated to accept conventional printing inks for the decorative and thematic promotional purposes of the lottery, but also for surface compatibility with variable computer controlled printing of game data with one or more of the several available variable printing means such as digital controlled laser-xerography; digital controlled ink-jet; digital controlled light emitting diode xerography; and digital controlled ion deposition printing.

In the conventional structure, the variably printed game data is covered by one or more of coatings designed to protect the game data from premature or unauthorized disclosure. These coatings include a first transparent varnish overlay of the game data to provide slip for the coin or other object used to scratch off a covering opaque composite coating of filled rubber which in turn may be coated or printed with decorative and thematic patterns or images.

The normal inclusion of a layer of thin aluminum foil was intended to prevent premature or unauthorized reading of the data by several principal non-destructive methods.

One non-destructive method prevented by the aluminum foil was the use of a strong light shone through the front of the ticket or as a mirror image viewed from the back of the ticket.

A second non-destructive method prevented by the foil was the delamination of the cardboard ticket by carefully separating the layer of paper first beneath the surface on which the game data is printed and then viewing the game data through this layer. By using aluminum foil as the layer on which the game data was printed such candling became impossible.

Early in the development of instant scratch-off lottery tickets the aluminum foil was believed necessary to diffuse soft X-rays. Mowever, X-ray detection of the game data became virtually impossible due to the use of ink-jet inks of little or no detectable radio opacity. Black paper fiber made into cardboard have defeated the technique in which the top layer of paper is delaminated and the game data viewed from below. (See U.S. Pat. No. 5,213,664 to Hansell). Accordingly, the need for an aluminum foil layer has been obviated by the use of low radio-opacity ink-jet type ink for the variable printing of the game data, and by the use of black fiber cardboard base material.

The various candling techniques for non-destructive premature reading of game data have also been defeated by the use of confusion patterns preferably printed beneath thematic overprints. Confusion patterns may also be printed on the cardboard surface beneath an opaque white layer when such opaque layers are used.

However, there remains to be defeated, the non-destructive technique of causing the migration or leaching of the ink of ink-jet printed game data through various printed and coated underlayers and through a non-metal clad cardboard when the rear surface is wetted by a pad of absorbent materials such as paper toweling or paper napkin saturated with water, or with water and water miscible solvents pressed against the rear side of the ticket. Variations of this basic technique include application of heated surfaces and variations in solvent constituents to a saturated paper towel or napkin to accelerate ink-jet ink migration. It has heretofore been the case that with this wet pad technique, a readable image of the game data can be transferred to the paper towel or napkin without causing residual evidence of tampering, once the lottery ticket has dried.

One solution to prevent migration or leaching of the ink of ink-jet printed data toward the substrate is to provide a specific ink-receiving formulation below the ink-jet printed data. The formulation would tend to immobilize the ink from the ink-jet by absorbing it. In other words, the ink-receiving formulation is selected such that the ink from the ink-jet defining the lottery data is substantially absorbed in the formulation. Once dried, the ink cannot therefore be drawn or leached through various layers below the ink layer and through the substrate, when the substrate is contacted by a solvent. While acceptable and highly desirable, this technique cannot be said to be foolproof. It is possible that a counterfeiter would experiment with a ticket or gaming form made in accordance with this technique to find a solvent or formulation which would cause the ink defining the lottery indicia to leach or migrate toward and through the substrate.

Accordingly, to further improve the security of a lottery ticket or gaming form made by the technique described in the previous paragraph, the inventors of the present invention have envisioned using a dye which would underlie the ink defining the game or lottery indicia. In the event, an attempt is made to detect or reveal the lottery indicia by contacting the back of the substrate with a solvent, the dye would excessively leak or bleed through the substrate thereby substantially staining the substrate. Since the dye is preferably black, the irregular, substantial staining would make it difficult to discern or read any information from any leaching or migration of the ink that may occur as a result of the contact between the solvent and the substrate.

The present technique, as described below in detail, would make unauthorized or premature detection of lottery indicia from the back of the lottery ticket or from the middle by splitting the ticket, significantly difficult.

OBJECTS AND SUMMARY OF THE INVENTION

It is an object of the invention to provide a piece of printed material having hidden, preprinted data, that overcomes the problems of prior art devices.

It is another object of the invention to provide printed material having concealed preprinted data which securely prevents the unauthorized, premature revealing of such hidden data.

It is yet another object of the invention to provide a piece of multilayered printed matter, particularly suited for scratch-off type lottery tickets.

It is yet another object of the invention to provide a lottery ticket having no metal foil layers, such as elemental aluminum, yet the structure of which prevents premature revealing of hidden, preprinted data.

It is yet another object of the invention to provide a lottery ticket or gaming form having no black paper substrate, yet the structure of which prevents premature or unauthorized detection or revealing of lottery indicia.

It is another object of the invention to provide a lottery ticket or gaming form in which the ink of the ink-jet printed game or lottery indicia is immobilized by being absorbed in an ink-receptive layer to thereby substantially prevent migration or leaching of the ink of the ink-jet toward the substrate.

It is yet a still further object of the invention to provide a scratch-off type lottery ticket in which the hidden data is printed with an ink having minimal radio opacity.

It is a further object of the invention to eliminate the thin aluminum foil layer incorporated on conventionally structured cardboard based instant scratch-off lottery tickets and yet prevent the premature disclosure of printed game data.

It is yet a further object of this invention to provide a lottery ticket with a structure that defeats all of the known non-destructive technique of premature game data disclosure in a non-metal clad cardboard instant scratch-off lottery ticket suitable for recycling into other paper products.

It is yet a further object of the invention to provide a lottery ticket with a structure that defeats the wet pad technique of premature game-data disclosure.

An additional object of the present invention is to provide a lottery ticket or gaming form in which unauthorized or premature detection of lottery or game indicia is prevented by immobilizing the ink of the ink-jet printed game indicia in a layer underlying the ink-jet layer.

Yet an additional object of the present invention is to provide a lottery ticket or gaming form in which unauthorized or premature detection of lottery or game indicia is further prevented by the provision of a bleeding dye which stains the substrate when contacted with a solvent thereby making it difficult to discern or read any information from any leaching or migration of the ink.

In summary, the present invention discloses a novel piece of printed matter which prevents premature or unauthorized disclosure of hidden, preprinted data.

The terms "instant scratch-off lottery ticket" and "instant scratch-off game ticket" are used for convenience only. It is to be understood that the present invention includes all types of printed material for which secure, preprinted hidden data is required. For example, it is expected that the features of our invention will be used to make more secure the preprinted, hidden control numbers on printed materials, such as manufacturer's discount coupons, food stamps, and bank security instruments, for example.

BRIEF DESCRIPTION OF THE DRAWINGS

The above and other objects and advantages and novel features of the present invention will become apparent from the following detailed description of the invention illustrated in the accompanying drawings, in which.

DETAILED DESCRIPTION OF THE INVENTION

Figure 1:
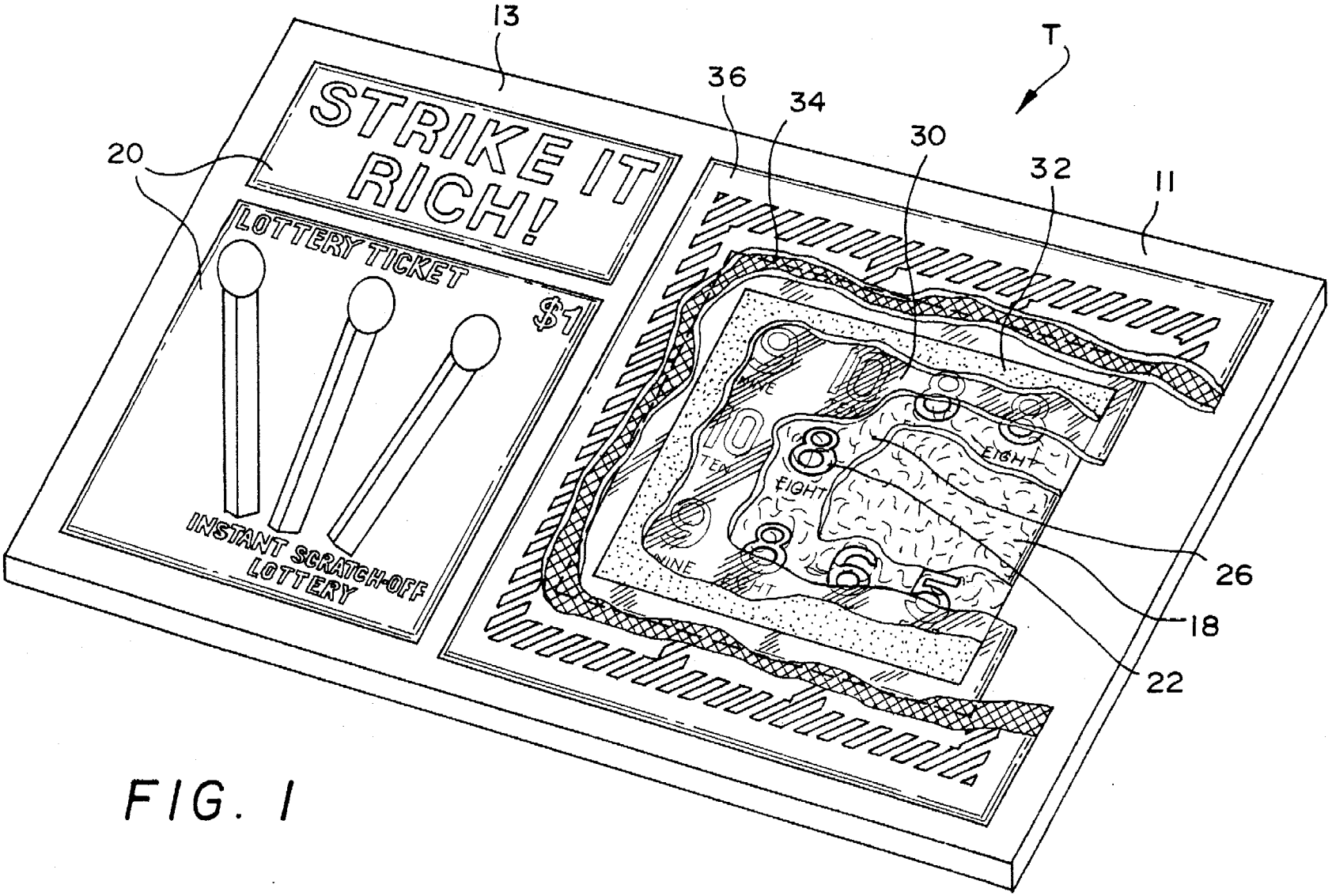
FIG. 1 is a perspective partially cutaway view of an instant scratch-off lottery ticket according to the invention showing some of the layers in the game play area.

This invention uses a dye, preferably black, which can be water soluble or organic solvent soluble, or a mixture of both. In most cases, the computer generated ink-jet printed indicia is made with a water soluble ink and the water soluble dye is the most appropriate method. If an unusual organic solvent ink was used an organic soluble dye could be substituted for the water soluble dye. If the maximum protection was required a mixture of a water soluble and an organic solvent soluble dyes could be used to cover all possibilities simultaneously.

The black dye would then be covered with a thick coating of a white ink or coating containing a typical white pigment, such. as, titanium dioxide, clay, calcium carbonate, alumina, or others known to one skilled in the art. This would allow for a surface, which is printable by standard printing techniques, for the appropriate graphical representations and for the indicia. The coating could be put down as a single application or as multiple applications. To prevent bleeding of the dye into the white layer a suitable solvent coating can be used over a water bleeding dye or an aqueous coating can be used over a solvent bleeding dye. Also, a water soluble dye could be incorporated with a small amount of binder which when dried would hold the in place for the brief time between application of a water based white coating and the drying of the white coating. However, under the longer period of water exposure needed for migration of the ink-jet printed indicia during an attempt to prematurely reveal the lottery or game data, the dye would be extracted from the binder and would bleed thereby staining the underlying substrate. Such a combination of dye and binder is normally referred to as a bleedable ink.

Both the dye and the white coating can be put down over the entire paper surface so that the base paper for printing with this security feature is usable in any configuration. Alternatively, both the dye and the white covering may be put down in a particular spot only under the indicia needing this level of security. The spot coated area can be done in a separate operation and then printed with appropriate register controls so that the protected area is in register with the area needing security, or the dye and the white can be printed in the same operation as the remaining printing operations for the gaming form and registered using techniques which are standard to one skill in the graphic arts. A "lilly pad", that is a white coating designed to absorb the special inks typically used for printing the indicia, can be used if desired over the previously applied white ink. If the white ink is formulated with the correct pigments, or if there are multiple layers of white ink with the topmost layer formulated with the correct pigments, the use of a "lilly pad" could be eliminated.

The remainder of the gaming form would be printed as is typical for this type of product. A confusion pattern, i.e., a discontinuous pattern of black ink or coating, may be used to prevent candling. If enough black dye is applied along with the standard coating, the form could be made opaque enough to eliminate the need for this confusion pattern. Alternatively, the black dye may be printed in a confusion pattern so as to prevent attempts at candling to discern any legible information.

With the described construction for the gaming form, any attempt to tamper with the form to determine the contents of the indicia will lead to the bleeding of the dye which will both hide the indicia from visibility and mark or stain the form in such a manner as to be obvious that it was tampered with. Since the placement of the dye is at the back of the gaming area, i.e., first down on the paper, it acts as an effective replacement for the foil on the standard lottery ticket/gaming form since the indicia are no longer observable from the back or center of the split ticket and can be used to prevent candling.

Figure 2:
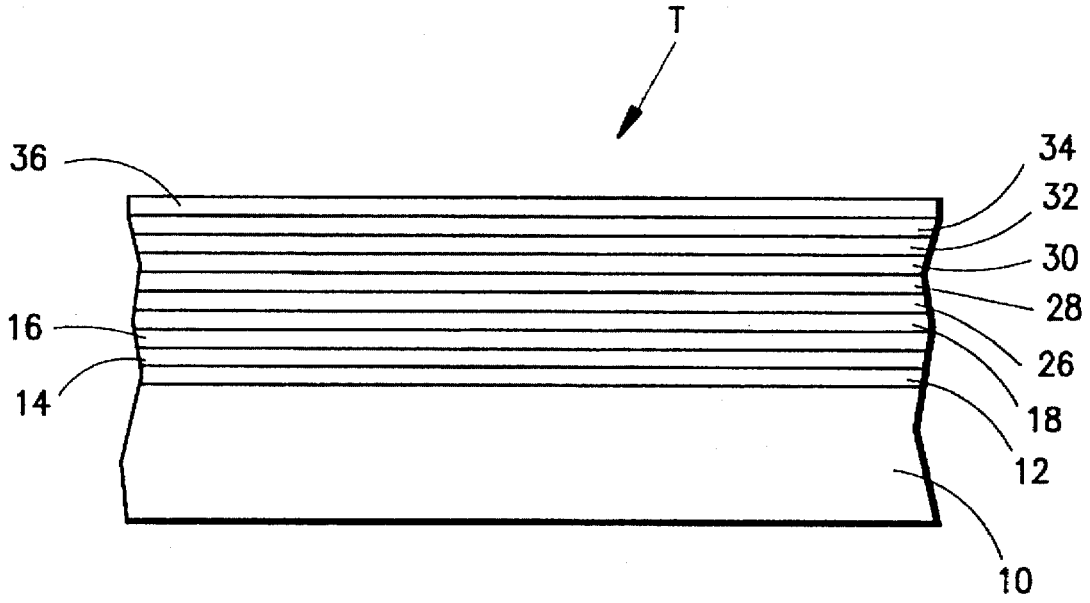
FIG. 2 is a schematic, cross-sectional view of the preferred embodiment of FIG. 1.

Referring now to FIGS. 1 and 2, the lottery ticket or gaming form T is formed on a cardboard substrate 10, with an optional opaque clay coating 12. The ticket T preferably includes a game-play area 11 and a theme area 13.

A layer 14 of black dye is provided over coating 12, and covered with a thick layer 16 of opaque white ink containing a white pigment, such as titanium dioxide, clay, calcium carbonate, alumina, antimony oxide, barium sulfate, or the like. The layer 14 can be of a nigrosine-based dye, such as:

Nigrosine 2BP Liquid, supplied by Keystone Aniline Corporation, Chicago, Ill.; Nigrosine O2P Powder, also supplied by Keystone Aniline Corporation, Chicago, Ill.; or, Nigausin Web. Crystals DK-8610, supplied by INX International Ink Corporation, Clifton, N.J. Alternatively, layer 14 can be of a formulated finished ink containing dye, such as: FGN-2289 Flexographic Ink, supplied by Colorcon Inc., West Point, Pa.; LOE 1092 Letterpress/Offset Ink, also supplied by Colorcon Inc., West Point, Pa.; or, EH 90264 Alkali Soluble Flexographic Ink, supplied by Environmental Ink Corporation, Linthicum, Md. Other acceptable dyes include:

Acid Black 2
C.I. 50420
Calco Nigrosine 0 2P
Lurazol Deep Blue EB
Nigrosin
Nigrosine B
Nigrosine black
Nigrosine CBRS
Nigrosine NB
Nigrosine NB conc
Nigrosine WL Water Soluble Nigrosine WLAH Nigrosine WSB Oil Black FS Special Oil Black S Orient Nigrosine BR Orient Water Black R 455

Orient Water Black R 510

Water Black R 455

Water Black R 500

Water Black R 510

In some cases, a combination of other conventional dyes, such as red, blue, and yellow may be utilized to make a black dye. An advantage of a mixture of colors is that it is possible to produce a tamper evident ticket, that is, if the different color dyes bleed at different rates, color shifts will occur in the black, and it would be possible to use this color shift to deter tampering by making such tampering evident. Although the use of blended colors is possible, the nigrosine-type dyes listed above are preferred.

A Benday pattern 18 is printed, usually in the same step in the printing as the thematic game graphics 20, over white ink layer 16. The purpose of the white ink layer 16 is to make surface 14 printable by standard printing techniques. One of ordinary skill in the art would recognize that dye layer 14 may only need be provided in the game play area 11.

The purpose of the Benday pattern 18 is to inconvenience a counterfeiter who would wish to cut out indicia from the game play area of a ticket and replace the same with indicia from another non-winning ticket to cause the first lottery ticket to appear to be a winner. The varying Benday lines (shown in FIG. 1), would tend to prevent the counterfeiter from cutting indicia from one ticket and adding it to another because the relative positions of Benday lines and overlying indicia vary from lottery ticket to lottery ticket and the discontinuity of Benday lines would be obvious to the redeeming agent. As best shown in FIG. 1, Benday pattern 18 is preferably in the form of short curved lines.

The Benday pattern 18 may be confined to the game play area 11, in which ink-jet printed game numerals or game-play data 22 are shown by example in FIG. 1. The thematic graphics 20 and the Benday pattern 18 are printed by conventional means such as lithographic, flexographic, or gravure techniques. The Benday pattern 18 is covered by a thin layer of a translucent ink-jet receptive layer 26. One purpose of the translucent ink-jet layer 26 is to provide sufficient contrast to the ink-jet produced game-play data 22 which by convention is normally black or deep grey.

Each of these layers is dried prior to the application of the subsequent layer. Once these layers have been applied and dried, the game-play data or image layer 28 is printed onto the receptive layer 26 by ink-jet printing means.

The ink-jet printed game-play data layer 28 is then covered by at least one layer of a clear varnish 30 and a layer of scratch-off material 32, such as Craigseal product 2850-HD manufactured by Craig Adhesives Corp., Newark, N.J. The clear varnish 30 acts to prevent damage to the game-play data layer 28 when the scratch-off material 32 is removed by lottery players. The scratch-off material 32 itself is over-printed with an optical confusion pattern 34 that is covered and hidden by over printed thematic graphics 36.

The overprinted thematic graphics 36 and the optical confusion pattern 34 are typically destroyed when a lottery player removes the scratch-off compound 32.

Figure 3:
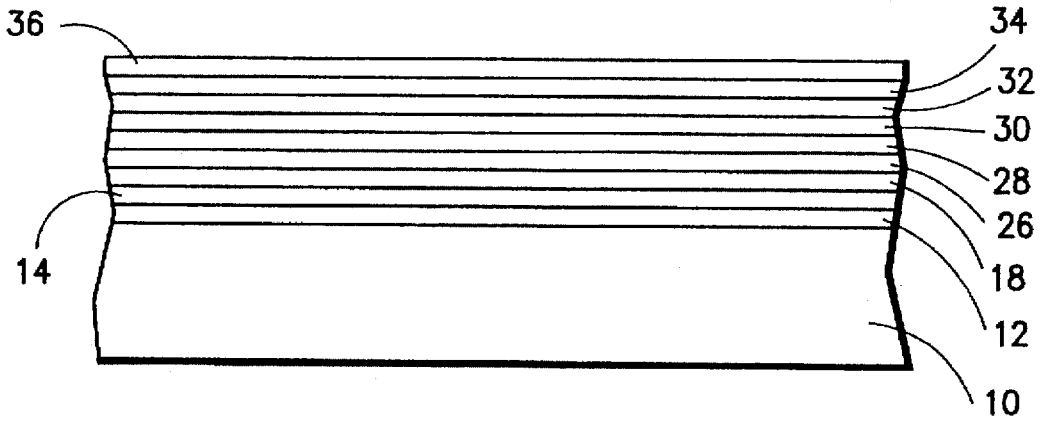
FIG. 3 is a schematic, cross-sectional view, similar to FIG. 2, of another preferred embodiment of the invention.

FIG. 3 illustrates another preferred embodiment of the invention. By control of the translucency and color of the ink-jet receptive layer 26, it is possible to eliminate the need for the underlying opaque white ink 16 of the embodiment of FIGS. 1 and 2. To achieve this desirable elimination, it is necessary that the ink-jet receptive layer 26 be sufficiently opaque to supply sufficient contrast to the ink-jet produced game-play data layer 28 which by convention is normally black or deep gray. In this embodiment it should be obvious that the dye layer 14 should only be provided in the game play area 11.

Additionally, we have found that by controlling the composition and thickness of the ink-jet receptive layer 26, we can obtain an instant scratch-off lottery ticket that resists the migration or leaching of the ink of the ink-jet produced gameplay data 28 layer through the ticket under the influence of any known wet pad technique, such as described above, to the point that readable migrated ink-jet patterns do not occur prior to obvious ticket destruction owing to warping and fading of the ticket that does not recover after drying.

We have found the receptive layer 26 to be effective when applied as an ink by either flexographic, gravure or silk screen techniques to a thickness of about 0.0025 to about 0.005 inches, and when the receptive layer ink is composed of finely divided fillers thoroughly mixed into a resinous binder and adjusted for viscosity with organic solvents.

TABLE 1 is a chart showing proportions of ingredients required to prepare an ink-jet receptive coating 26 for either flexographic, gravure or silk screen application.

TABLE 1

INK-JET RECEPTIVE FORMULATIONS

| | FLEXOGRAPHIC | GRAVURE | SILKSCREEN |
|---|---|---|---|
| FILLER: Mixtures of finely divided clay, silica, titanium dioxide, calcium carbonate. | 20–40% | 17.5–35.5% | 21–42% |
| THERMOPLASTIC RESIN VEHICLE: acrylic or polyester or polyamide. | 70–50% | 62.5–44.5% | 74–53% |
| SOLVENT: Mixtures of AROMATIC/ALIPHATIC napthas, n-propanol, ethanol, VM&P naptha, propyleneglycol-methylether | 10–12% | 20–25% | 5–10% |

VM&P naptha is the standard term in the trade for Varnish Maker's and Painter's naptha.

Surprisingly, we have found that in addition to providing the benefit of a structure that prevents premature or unauthorized game data disclosure, these compositions of the receptive layer set forth in TABLE 1 enhance the appearance of the ink-jet fonts by causing a slight feathering of the images' individual droplets into the images of adjacent droplets.

In use, we have found that titanium dioxide based white inks provide good results.

It is likewise contemplated that the receptive layer 26 contain particles of titanium dioxide, calcium carbonate, calcium chloride, calcium hydroxide, calcium oxide, calcium silicate, zinc sulfide, magnesium carbonate and the like.

It is further contemplated that the receptive layer 26 contain acid compounds where no conflict exists with the basic components, e.g., calcium carbonate and calcium hydroxide. Many acids could be used and include both mineral acids and organic acids. The possibilities are too numerous to list and would be known to those skilled in the art. Some examples are nitric acid, phosphoric acid, acetic acid, maleic acid, citric acid, crotonic acid, tartaric acid, and benzoic acid and its derivatives. We have found that the inclusion of an acid further prevents leaching or migration of the ink-jet ink toward the substrate.

It is contemplated that the ink-jet receptive layer contain particles of compounds of sufficient surface reactivity to hinder or resist leaching of the ink-jet inks.

It is also expected that the ink-jet ink be selected to minimum radio opacity for hindering unauthorized detection of hidden data by x-ray detection methods.

While this invention has been described as having preferred designs, it is understood that it is capable of further modifications, uses and/or adaptations of the invention following in general the principle of the invention and including such departures from the present disclosure as come within the known or customary practice in the art to which to invention pertains and as may be applied to the central features hereinbefore set forth, and fall within the scope of the invention and of the limits of the appended claims.

What is claimed is:

1. An instant lottery ticket with improved security to prevent unauthorized detection of lottery indicia, comprising:

a) a substrate including a play area;

b) lottery indicia disposed in said play area;

c) means disposed between said substrate and said lottery indicia for receiving ink from said lottery indicia;

d) said ink receiving means including first security means for substantially preventing unauthorized detection of said lottery indicia; and e) second security means disposed between said ink receiving means and said substrate for further substantially preventing unauthorized detection of said lottery indicia.

2. The lottery ticket of claim 1, wherein:

a) said first security means comprises means for substantially preventing migration of ink from said lottery indicia toward said substrate.

3. The lottery ticket of claim 2, wherein:

a) said ink migration preventing means comprises an elemental-metal-free ink.

4. The lottery ticket of claim 2, wherein:

a) said ink migration preventing means comprises a formulation including calcium carbonate.

5. The lottery ticket of claim 2, wherein:

a) said ink migration preventing means comprises a formulation selected from the group consisting of calcium chloride, calcium hydroxide, calcium oxide, calcium silicate, zinc sulfide, and magnesium carbonate.

6. The lottery ticket of claim 2, wherein:

a) said ink migration preventing means comprises an acid.

7. The lottery ticket of claim 2, wherein:

a) said ink migration preventing means comprises an acid selected from the group consisting of nitric acid, phosphoric acid, and acetic acid.

8. The lottery ticket of claim 2, wherein:

a) said ink migration preventing means comprises an acid selected from the group consisting of maleic acid, citric acid, crotonic acid, tartaric acid, and benzoic acid.

9. The lottery ticket of claim 1, and including:

a) a substantially opaque white ink formulation disposed between said ink-receiving means and said second security means.

10. The lottery ticket of claim 1, wherein:

a) said second security means comprises bleeding means for staining said substrate when said substrate is contacted with a solvent.

11. The lottery ticket of claim 10, wherein:

a) said bleeding means comprises a dye.

12. The lottery ticket of claim 11, wherein:

a) said dye comprises a nigrosine dye.

13. The lottery ticket of claim 10, wherein:

a) said bleeding means comprises an ink formulation.

14. The lottery ticket of claim 13, wherein:

a) said ink formulation includes a dye.

15. The lottery ticket of claim 14, wherein:

a) said dye comprises a nigrosine dye.

16. The lottery ticket of claim 10, wherein:

a) said dye comprises a black dye formulated from a mixture of different dyes.

17. An instant lottery ticket with improved security to prevent unauthorized detection of lottery indicia, comprising:

a) a substrate including a play area;

b) an ink layer defining lottery indicia disposed in said play area;

c) an ink-receptive layer disposed between said ink layer and said substrate;

d) said ink-receptive layer including means for substantially preventing migration of ink from said ink layer toward said substrate; and e) bleeding means disposed between said ink-receptive layer and said substrate for staining said substrate when said substrate is contacted with a solvent.

18. The lottery ticket of claim 17, wherein:

a) said ink migration preventing means comprises an elemental-metal-free ink.

19. The lottery ticket of claim 17, wherein:

a) said ink migration preventing means comprises a formulation including calcium carbonate.

20. The lottery ticket of claim 17, wherein:

a) said ink migration preventing means comprises a formulation selected from the group consisting of calcium chloride, calcium hydroxide, calcium oxide, calcium silicate, zinc sulfide, and magnesium carbonate.

21. The lottery ticket of claim 17, wherein:

a) said ink migration preventing means comprises an acid.

22. The lottery ticket of claim 17, wherein:

a) said ink migration preventing means comprises an acid selected from the group consisting of nitric acid, phosphoric acid, and acetic acid.

23. The lottery ticket of claim 17, wherein:

a) said ink migration preventing means comprises an acid selected from the group consisting of maleic acid, citric acid, crotonic acid, tartaric acid, and benzoic acid.

24. The lottery ticket of claim 17, wherein:

a) said bleeding means comprises a dye.

25. The lottery ticket of claim 24, wherein:

a) said dye comprises a nigrosine dye.

26. The lottery ticket of claim 17, wherein:

a) said bleeding means comprises an ink formulation.

27. The lottery ticket of claim 26, wherein:

a) said ink formulation includes a dye.

28. The lottery ticket of claim 27, wherein:

a) said dye comprises a nigrosine dye.

29. The lottery ticket of claim 24, wherein:

a) said dye comprises a black dye formulated from a mixture of different dyes.

30. The lottery ticket of claim 17, and including:

a) a substantially opaque white ink formulation disposed between said ink-receptive layer and said bleeding means.

* * * * *